United States Patent [19]

Yorita et al.

[11] Patent Number: 4,906,955

[45] Date of Patent: Mar. 6, 1990

[54] DIELECTRIC FILTER

[75] Inventors: Tadahiro Yorita; Takashi Maruyama, both of Nagaokakyo, Japan

[73] Assignee: Murata Manufacturing Co., Ltd., Japan

[21] Appl. No.: 281,555

[22] Filed: Dec. 8, 1988

[30] Foreign Application Priority Data

Dec. 10, 1987 [JP] Japan ..... 62-188230[U]

[51] Int. Cl.[4] ..... H01P 1/202

[52] U.S. Cl. ..... 333/207; 333/202; 333/223

[58] Field of Search ..... 333/202–207, 333/208, 210, 212, 219, 219.1, 222, 223, 235

[56] References Cited

U.S. PATENT DOCUMENTS 4,342,972 8/1982 Nishikawa et al. ..... 333/222 X 4,686,496 8/1987 Syrett et al. ..... 333/202

FOREIGN PATENT DOCUMENTS 0073501 5/1982 Japan ..... 333/202

*Primary Examiner*—Eugene R. LaRoche

*Assistant Examiner*—Seung Ham

*Attorney, Agent, or Firm*—Ostrolenk, Faber, Gerb & Soffen

[57] ABSTRACT

A dielectric filter includes a plurality of coaxial resonators constituted by inner conductors formed on inner walls of a plurality of throughholes which are formed in parallel with each other on a dielectric block and an outer conductor which is formed on an outer surface of the dielectric block. A printed circuit board is disposed at a side of an open end of the dielectric block, and the printed circuit board and the dielectric block are accommodated in a metallic case which is electrically connected to the outer conductor. A projecting portion is formed on an inner surface of the metallic case to support the printed circuit board such that a predetermined gap can be formed between the printed circuit board and a bottom surface of the metallic case by the projecting portion, whereby a stray capacity is reduced. Therefore, it is possible to prevent resonant frequencies of the coaxial resonators from being changed or fluctuated, and thus a filter characteristic of the dielectric filter becomes good.

5 Claims, 2 Drawing Sheets

DIELECTRIC FILTER

BACKGROUND OF THE INVENTION

1. Field of the Invention

The present invention relates to a dielectric filter. More specifically, the present invention relates to a dielectric filter in which a plurality of coaxial resonators are formed in a dielectric block and a printed circuit board is disposed at a side of an open end of the dielectric block.

2. Description of the Prior Art

The same assignee of the present invention has proposed such a kind of dielectric filter in, for example, Japanese Patent Application No. 254452/1986 (Japanese Patent Laid Open No. 108801/1988 laid open on May 13, 1988).

Such a dielectric filter is constituted by a plurality of coaxial resonators formed on a dielectric block, as shown in FIG. 6. The dielectric filter having such construction is well known, and therefore, more detail description thereof is omitted here.

In this proposed dielectric filter, in order to easily adjust a filter characteristic by trimming or to form an attenuation pole in the filter characteristic, at a side of an open end of the dielectric block 1, a printed circuit board 2 to which predetermined coaxial resonators are connected is disposed, and the dielectric block 1 and the printed circuit board 2 are covered by a metallic case 3 to which an outer conductor (ground electrode) is connected.

In the dielectric filter as shown in FIG. 6, since the printed circuit board 2 is fixed closely to metallic case 3, a large stray capacity is formed between a hot pattern (not shown) of the printed circuit board 2 and the metallic case 3. Since such a stray capacity is greatly changed in accordance with a state or degree of contact of the printed circuit board 2 and the metallic case 3, change or fluctuation of resonant frequencies of the coaxial resonators occur, and therefore, a whole filter characteristic is changed. It takes a long time to adjust the filter characteristic so as to avoid influence of the stray capacity upon the filter characteristic. Thus, there was a problem in the above described dielectric filter that mass-productivity is not so good.

SUMMARY OF THE INVENTION

Therefore, it is a principal object of the present invention to provide a dielectric filter in which mass productivity can be increased by avoiding influence of a stray capacity upon a filter characteristic.

In brief, a dielectric filter in accordance with the present invention is constituted by a plurality of coaxial resonators including inner conductors formed on inner surfaces of a plurality of throughholes being formed in a dielectric block and common outer conductor, and further comprises a printed circuit board disposed at a side of an open end of the dielectric block and a metallic case covering the printed circuit board and connected to the outer conductor, characterized in that a projecting portion is formed on the metallic case so as to maintain a predetermined gap between the printed circuit board and the metallic case.

A predetermined gap is formed between the printed circuit board and the metallic case by the projecting portion formed on the metallic case, whereby a stray capacity can be decreased.

In accordance with the present invention, a spacing or gap between the printed circuit board and the dielectric block, that is, respective coaxial resonators is always kept at constant by the projecting portion, and therefore, the aforementioned stray capacity can be decreased and becomes stable. Therefore, change or fluctuation of the resonant frequencies of the coaxial resonators becomes small and stable, whereby it is possible to easily adjust the filter characteristic, and thus, it is respectable to increase mass-productivity.

The objects and other objects, features, aspects and advantages of the present invention will become more apparent from the following detailed description of the embodiments of the present invention when taken in conjunction with accompanying drawings.

DETAIL DESCRIPTION OF THE PREFERRED EMBODIMENTS

Figure 1:
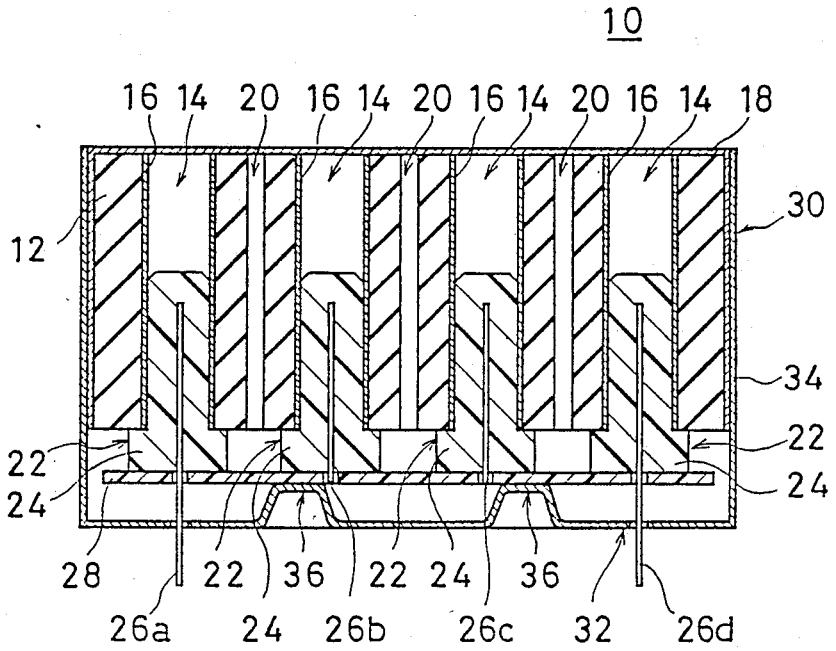
FIG. 1 is an illustrative cross-sectional view showing one embodiment in accordance with the present invention.
Figure 2:
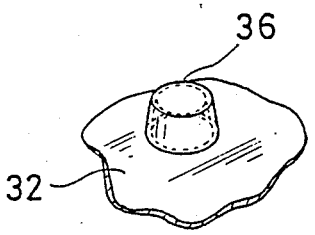
FIG. 2, FIG. 3, FIG. 4 and FIG. 5 are partial perspective views respectively showing different examples of a projecting portion.

FIG. 1 is an illustrative cross-section view showing one embodiment in accordance with the present invention. A dielectric filter 10 includes a cubic dielectric block 12 composed of, for example, titanium oxide series ceramics, and a plurality of throughholes 14 are vertically formed in parallel with each other on the dielectric block. Then, inner conductors 16 composed of metallic film are respectively formed inner walls of the throughholes 14. In addition, on an outer surface of the dielectric block 12, an outer conductor 18 composed of metallic film is formed except for an open end, that is, a bottom surface in FIG. 1. The outer conductor 18 is electrically connected to respective inner conductors 16 at a short-circuit end. Thus, $\lambda/4$ coaxial resonator is formed for each throughhole 14 by the dielectric block 12, each inner conductor 16 and the outer conductor 18.

Between the respective throughholes 14, coupling holes 20 which penetrate the dielectric block 12 in a direction of length thereof, i.e. vertically. No conductors are formed on inner surfaces of the coupling holes 20, and therefore, adjacent ones of the above described coaxial resonators are electrically and magnetically coupled to each other by the coupling holes 20 so as to exhibit a filter characteristic as a whole. Since such a dielectric filter itself has been well known, more detail description thereof will be omitted here.

Dielectric bushings 22 are inserted into respective throughholes 14 from the open end of the dielectric block 12 where no outer conductor 18 is formed. Respective dielectric bushings 22 provided with metallic pins **26*a*–26*d* each of which is projected downward from the lower surface of flange portions 24 at the center thereof. Then, at the lower surfaces of dielectric bushings 22, a printed circuit board 28 composed of insulating material such as alumina, Teflon (trademark) glass, or the like is fixed. A gap between the printed circuit board 28 and the open end surface of the dielectric block 12 is set or decided by the height of the flange portions 24 of the dielectric bushings 22**.

Although not shown, suitable conductive patterns are formed on the printed circuit board 28. By connecting or not connecting any coaxial resonators, that is, the metallic pins **26*b* and/or 26*c*** to the conductive patterns, as necessary, as described above, the filter characteristic can be changed or the attenuation pole can be formed in the filter characteristic.

Meanwhile, FIG. 1 is by way of illustration and example only, and a specific filter characteristic is determined by a form of the above described conductive patterns, the number and positions of the coaxial resonators being connected to the conductive patterns, reactance values, and so on. However, such a specific construction is not important to the present invention, and therefore, more detail description is omitted here.

Then, the metallic pin **26*a* being coupled to the coaxial resonator of the first stage and the metallic pin 26*d* being coupled to the coaxial resonator of the last stage are respectively not connected to the printed circuit board 28 and further extended downward through the printed circuit board 28. However, the metallic pins 26*a* and 26*d* may be connected to the printed circuit board 28. Then, for example, the metallic pin 26*a* becomes an input terminal and the metallic pin 26*d*** becomes an output terminal.

In addition, a metallic cover or case 30 is provided, which includes a bottom plate 32 and side plates 34 standing up at the both ends of the bottom plate 32. The side plates 34 of the metallic case 30 are electrically connected and mechanically fixed to the outer conductor 18, whereby the open end can be electrically and magnetically shielded by the metallic case 30. It is to be noted that projections 36 having predetermined height are formed on the bottom plate 32 of the metallic case 30 such that a predetermined gap can be formed and kept between the printed circuit board 28 and the bottom plate 32 of the metallic case 30. By forming such a gap, it is possible to decrease a stray capacity between the hot pattern (not shown) formed on the printed circuit board 28 and the metallic case 30.

In the case where the coaxial resonators are $\lambda/4$ resonators, the stray capacity Cs, a resonant angle frequency $\omega$, a characteristic impedance Z, an effective permittivity $\epsilon r$, length of the resonator l, and light velocity c are represented in a relationship of the following equation (1).

$$1/\omega Cs = Z \cdot \tan \omega \sqrt{\delta r}\ l/c \qquad (1)$$

$$\omega = 2\pi f \ (f\text{: resonant frequency})$$

On the other hand, in the case where no influence of the stray capacity Cs occur, resonant frequency fo is represented by the following equation (2).

$$fo = c/4\sqrt{\epsilon r}\ l \qquad (2)$$

With substitution of specific values in the equations (1) and (2), in the case where the characteristic impedance Z=10 ohms, the effective permittivity $\epsilon r=90$ and the length of the resonator l=9 mm, when no influence of the stray capacity Cs occurs, the resonant frequency fo can be evaluated as fo=887.8 MHz in accordance with the equation (2).

Next, if 1pF of the stray capacity Cs exhibits, in the above described example, the resonant frequency f becomes 848 MHz in accordance with the equation (1). This means that the resonant frequency is lowered by approximately 30 MHz by 1pF of the stray capacity Cs. Therefore, if the stray capacity Cs changes or fluctuates at 10%, the resonant frequency f changes or fluctuates more than 3 MHz. Therefore, necessary filter characteristic can not be obtained.

However, in accordance with the present invention, if and when a predetermined gap is formed between the printed circuit board 28 (hot pattern) and the metallic case 30 (the bottom plate 32) by the projections 36, it is possible to decrease the stray capacity Cs to, for example, 0.1pF. Therefore, change or fluctuation of the resonant frequency f by the stray capacity Cs becomes small, for example, less than 3 MHz. Therefore, if the stray capacity Cs changes or fluctuates at 10%, the resonant frequency f does not change or fluctuate more than b 300 kHz and therefore, such change or fluctuation of the resonant frequency f almost never affect the filter characteristic.

Figure 3:
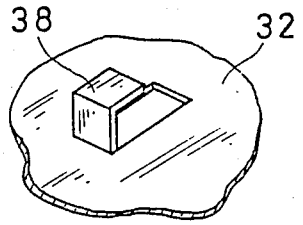

In addition, the above described projections 36 may be formed by embossing or burring, and further the projection 36 may be formed as cut-out plate 38 as shown in FIG. 3. Furthermore, the number of such a projection or cut-out plate may be one or more and arbitrary.

Figure 4:
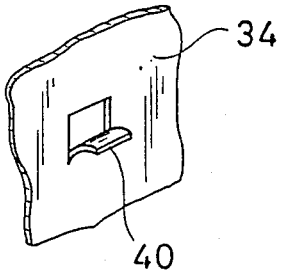
Figure 5:
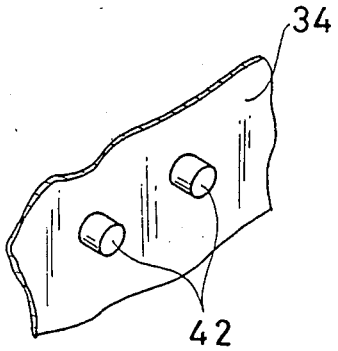
Figure 6:
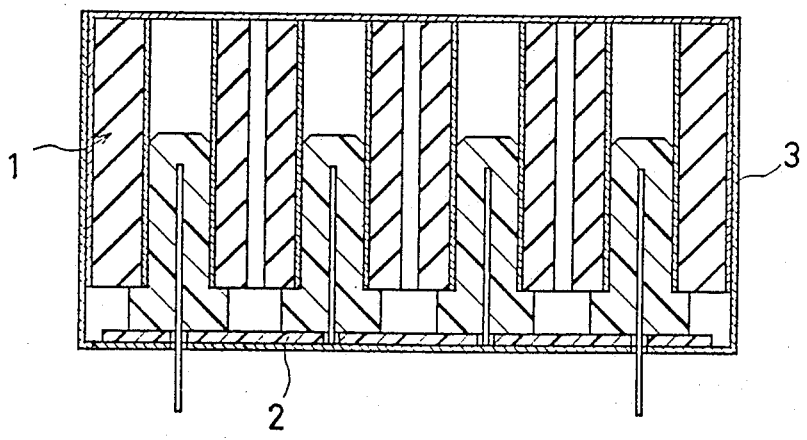
FIG. 6 is an illustrative cross-sectional view showing one example of a dielectric filter which constitutes the background of the present invention.

Furthermore, in the above described embodiment, the projecting portion is formed on the bottom plate 32 of the metallic case 30; however, the projecting portion may be formed on the side plate 34 of the metallic case 30 as shown in FIG. 4 or FIG. 5.

In FIG. 4 embodiment, cut-out plates 40 are formed on the both side plates 34 at the same height, and both ends of the printed circuit board 28 are engaged and supported by the cut-out plates 40 such that a predetermined gap between the printed circuit board 28 and the metallic case 30 can be maintained.

The above described cut-out plate 40 may be substituted with projection 42 formed by embossing as shown in FIG. 5.

In the above described embodiment, the printed circuit board 28 is supported by the projecting portions being projected inward from the side plate 34; however, such a projecting portion may be formed to be projected outward from the side plate 34 such that recess portions can be formed on inner surfaces of the side plate 34 and the both ends of the printed circuit board 28 are engaged and supported by the recess portions.

It is considerable that stepped portions are formed on the side plate 34 and a predetermined gap is formed between the printed circuit board 28 and the metallic case 30 by such a stepped portion. Therefore, it is to be understood that in the specification, in order to include or cover all kinds of the above described projection, cut-out plate, recess portion, stepped portion or the like, the term "projecting portion" is utilized.

Furthermore, this projecting portion is formed on the metallic case 30 in a one-piece fashion; however, the projecting portion may be separately formed and fixed to the metallic case 30 by, for example, adhering or soldering.

In addition, the printed circuit board 28 and the projecting portion which supports the same may be fixed to each other by adhering or soldering, as necessary.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dielectric filter, comprising:

a dielectric block substantially in the form of a rectangular parallelepiped having two main surfaces, top and bottom surfaces, and two side surfaces, said dielectric block being formed with a plurality of throughholes extending from said top surface to said bottom surface in a direction parallel with said two main surfaces, respective inner conductors being formed on inner surfaces of said throughholes, an outer conductor being formed on an outer surface of said dielectric block, said outer conductor being formed on at least one of said top and bottom surfaces, said inner conductors and said outer conductor forming a plurality of coaxial resonators in said dielectric block, and said ends of said resonators at said surface where no outer conductor is formed being open ends of the resonators;

a printed circuit board disposed adjacent and substantially parallel with said open ends of said dielectric resonators with a predetermined gap defined between said printed circuit board and said block;

a metallic case in which said dielectric block and said printed circuit board are accommodated, said metallic case being connected to said outer conductor and having a bottom plate; and a projecting portion which is formed on an inner surface of said metallic case and supports said printed circuit board to maintain a predetermined gap between said printed circuit board and said bottom plate of said metallic case.

2. A dielectric filter in accordance with claim 1, wherein said metallic case includes side plates, and said projecting portion is formed on inner surfaces of said side plates of said metallic case.

3. A dielectric filter in accordance with claim 1, wherein said projecting portion is formed on an inner surface of said bottom plate of said metallic case.

4. A dielectric filter in accordance with claim 3, wherein said bottom plate is adjacent the bottom surface of said block.

5. A dielectric filter in accordance with claim 4, wherein said open ends of said resonators are at said bottom surface of said block.

* * * * *